United States Patent [19]

Lepley

[11] Patent Number: 4,522,184

[45] Date of Patent: Jun. 11, 1985

[54] SILICON CONTROLLED RECTIFIER SHUT-OFF CIRCUIT FOR CAPACITIVE DISCHARGE IGNITION SYSTEM

[75] Inventor: Joseph M. Lepley, Youngstown, Ohio

[73] Assignee: Altronic, Inc., Youngstown, Ohio

[21] Appl. No.: 603,162

[22] Filed: Apr. 23, 1984

[51] Int. Cl.[3] ..... F02P 3/08

[52] U.S. Cl. ..... 123/599; 123/605; 315/209 CD; 315/209 SC

[58] Field of Search ..... 123/599, 604, 605; 315/209 CD, 209 SC, 218; 361/256, 259

[56] References Cited

U.S. PATENT DOCUMENTS

| | | | |
|---|---|---|---|
| 3,729,647 | 4/1973 | Mainprize | 315/209 CD |
| 3,750,637 | 8/1973 | Minks | 315/209 CD |
| 4,216,756 | 8/1980 | Mura | 123/599 |

*Primary Examiner*—Andrew M. Dolinar

*Attorney, Agent, or Firm*—Webb, Burden, Robinson & Webb

[57] ABSTRACT

A capacitive discharge ignition system for an internal combustion engine and for use with a generator powered current source comprises a storage capacitor, at least one thyristor for discharging the storage capacitor to transfer energy to at least one spark plug and a trigger circuit for gating the at least one thyristor in synchronism with an internal combustion engine with which the ignition system may be associated. The improvement according to this disclosure comprises the storage capacitor is discharged through a diode circuit, a solid state device for switching the output of the generator to ground, a circuit sensing flow in the discharge diode circuit and generating a discharge signal indicative thereof, and a circuit gating the solid state device into conduction in response to said discharge signal.

9 Claims, 2 Drawing Figures

SILICON CONTROLLED RECTIFIER SHUT-OFF CIRCUIT FOR CAPACITIVE DISCHARGE IGNITION SYSTEM

BACKGROUND OF THE INVENTION

The problem of turning of SCRs in capacitive discharge ignition systems is well known. A number of patents have addressed shutting down the anode to cathode current from the source charging the storage capacitor. These have all related to direct current to direct current converter power supplies which can be electronically shut-down. See, for example, U.S. Pat. Nos. 3,583,378; 3,800,771; 3,838,328; and 4,069,801. The output of an alternator or generator cannot be switched off as can direct current converter power supplies. The output being an alternating current will periodically pass through zero. At this time, the SCR will shut down. However, it is desired to shut down the SCR immediately, that is, without waiting for the next polarity reversal of the alternator or generator. The applicant's circuit is directed to the shut-off of the power SCR in a capacitive discharge ignition system supplied by a generator or alternator.

SUMMARY OF THE INVENTION

This invention is an improvement in circuits for capacitive discharge ignition systems for internal combustion engines which ignition systems are charged by a generator or alternator. Capacitive discharge ignition systems comprise a storage capacitor charged through a diode or full wave rectifier and at least one silicon controlled rectifier (SCR) or other suitable thyristor for discharging the storage capacitor to the primary of an ignition coil. A trigger circuit provides a gate pulse to the SCR gate in synchronism with the internal combustion engine. The improvement comprises a circuit including a solid state device for grounding the output of the generator or full wave rectifier during the discharge of the storage capacitor. Preferably, the solid state device is an FET of the type having very high gate input impedance. The storage capacitor is discharged through a diode circuit. A circuit senses flow in the discharge diode circuit and generates a signal indicative thereof. Preferably, a shunt circuit in parallel with the diode discharge circuit draws current when the discharge diode or diodes reach saturation. The shunt circuit may include a current limit resistor and the light emitting diode of the solid state device into conduction. Preferably, the gating circuit comprises the phototransistor of an optocoupler. The gating circuit charges a holding capacitor at the gate of the FET switch. Preferably, zener diode limits the voltage on the capacitor to less than the breakover voltage of the FET gate. A discharge resistor is placed across the capacitor.

After the storage capacitor starts to discharge and when the discharge diode saturates, the current shunted through the optocoupler gates the phototransistor into conduction. Almost immediately, the holding capacitor is charged from the storage capacitor to the threshold level of the FET gate and the FET shorts the output of the full wave rectifier to ground. As the storage capacitor discharges, its charge falls below the charge on the holding capacitor before the storage capacitor is fully discharged. However, the holding capacitor keeps the voltage at the FET gate above the threshold voltage until after the storage capacitor has completely discharged and, therefore, the SCR has turned off.

THE DRAWINGS

Further features and other objects and advantages of this invention will become clear from the following detailed description made with reference to the drawings in which FIG. 1 is a schematic diagram of the circuit according to this invention having a phototransistor in the gating circuit; and FIG. 2 is a schematic diagram of the circuit according to this invention having a simple bipolar transistor in the gating circuit.

DESCRIPTION OF THE PREFERRED EMBODIMENT

Figure 1:
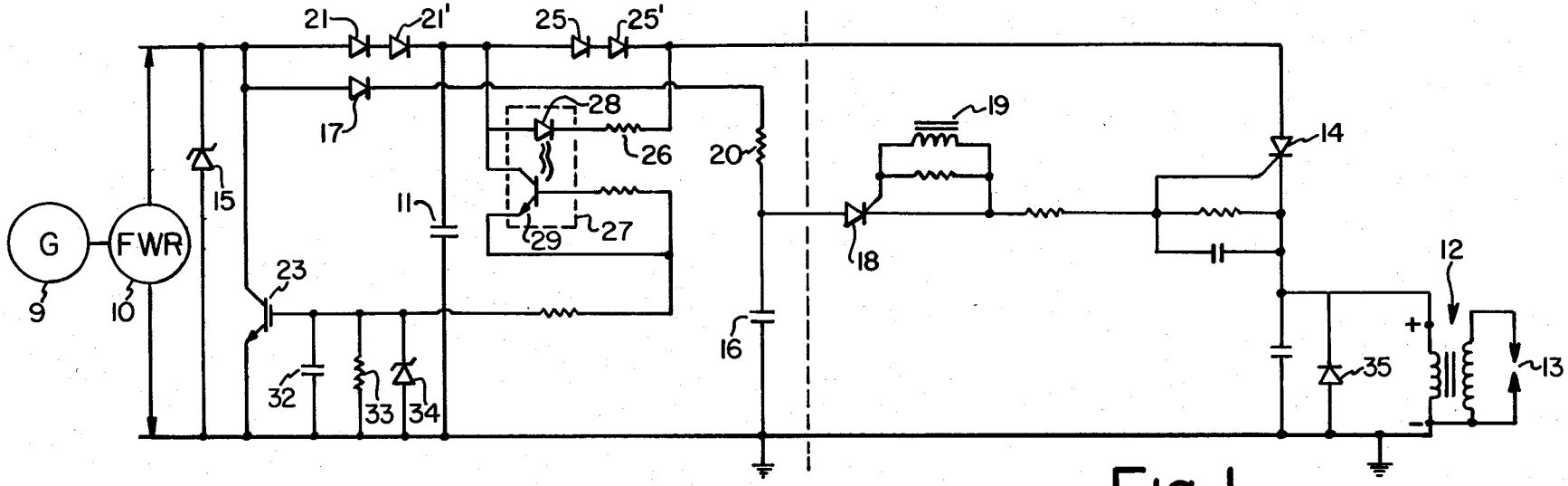

Referring now to FIG. 1, there is shown a capacitive discharge ignition system for one cylinder of an internal combustion spark ignition engine. Each component to the right of the dashed line is replicated the number of times there are cylinders to be served. For purposes of illustration of the instant invention, the circuit for one cylinder will suffice.

The storage capacitor 11 is charged by the output of the full wave rectifier 10 to store energy between each spark plug firing. The alternating current input to the full wave rectifier is taken from a generator 9 or alternator associated with the engine. The energy stored on the storage capacitor is discharged to the primary of a step-up coil 12. The secondary of the step-up coil is connected across the spark plug 13 (or plugs) as shown. Discharge of the storage capacitor 11 to the coil 12 is gated by SCR 14. The zener diode 15 limits the voltage across the storage capacitor 11.

A timing circuit for triggering the SCR 14 into conduction comprises a trigger capacitor 16 charged through diode 17 and resistor 20 and a trigger SCR 18. The basic characteristics of an SCR are well known and as follows: a positive pulse at the gate will start anode cathode current flowing and that flow will continue until two conditions are simultaneously met; namely, removal of the positive pulse at the gate and drop of the anode cathode current below the holding current level for the SCR.

A magnetic pick-up coil 19 or similar pick-up device provides a synchronized pick-up pulse to the gate of the trigger SCR 18. The trigger SCR then discharges capacitor 16 to the gate of main SCR 14 driving it into conduction. The trigger capacitor and trigger SCR amplify the pick-up pulse. They also provide isolation between the pick-up pulse (which may not fall off rapidly) and the main SCR. The discharge of the trigger capacitor is completed before the magnetically induced trigger pulse is removed from the gate of SCR 18. This is important to the quick turn off of the main SCR 14. All of the elements and the arrangement thereof described so far are old in the art. Turn off of the power SCR 14 has remained a problem even with the isolation provided by the resistor through which the trigger capacitor is charged, trigger capacitor and trigger SCR as described above. Even if the gate pulse is removed, SCR 14 will continue to conduct as long as there is a source of anode cathode current. The generator and full wave rectifier 10 can supply that current even after the storage capacitor is discharged. What follows is a description of the improvement for insuring shut-down of SCR 14 by grounding the output of the full wave rectifier or the generator as the case may be during just the right ime period.

Diodes 21 and 21' are arranged in series between the full wave rectifier and the storage capacitor 11. Field effect transistor (FET) 23 is arranged to ground the output of the full wave rectifier but not to discharge the storage capacitor. The diodes 21 and 21' prevent discharge of the storage capacitor 11 when the FET 23 is conducting. (With the embodiment shown in the drawing, the output of the full wave rectifier is grounded. If the output of the generator is grounded, it will be necessary to provide back-to-back FETs between the output and ground in order that both positive and negative output pulses are diverted away from the full wave rectifier and thus the storage capacitor. In this embodiment, the diodes 21 and 21' are not required as their function would be served by the full wave rectifier itself).

The circuit for controlling the on time of FET 23 will now be described. The storage capacitor 11 is charged through FWR 10 and is discharged through diodes 25, 25'. In shunt with the discharge diodes 25, 25' is a current sensing circuit comprising a resistor 26 and the light emitting diode 28 of an optocoupler 27 of the phototransistor type. During discharge of the storage capacitor 11 through diodes 25, 25' as saturation voltage across diodes 25, 25' is reached, current is shunted through the optocoupler 27. The resistor 26 limits the maximum current through the light emitting diode of the output coupler to say, about, 30 milliamps in a device requiring about 10 milliamps to gate the phototransistor into conduction. (It should be noted that optocouplers are available with breakdown voltages in the range 200 to 300 volts which is sufficient for most ignition systems wherein the voltage on the storage capacitor does not exceed 200 volts.)

Almost immediately after the phototransistor 29 begins conducting, capacitor 32 is charged from the storage capacitor 11 through diode 30, resistor 31, and optocoupler 27. The positive voltage at the gate of the FET 23 enables current flow from the source to the drain of the FET shorting the full wave rectifier to ground. Since, the FET gate has a very high input impedance, the capacitor 32 does not discharge through the gate. Also, charge on the capacitor cannot reach the breakover voltage of the FET gate because it will first discharge through protective zener 34. As the storage capacitor 11 discharges, the voltage drops down below that across capacitor 32 and, therefore, it can no longer supply current to capacitor 32. Were the FET to cease conducting at this time, it would do so before the storage capacitor had fully discharged. Nothing would be gained by the added circuitry because the holding circuit for SCR 14 would never be cut off. The FET must remain conducting until after the capacitor 11 fully discharges. The RC time constant of the capacitor 32 and resistor 33 are selected to vary the time when the voltage on capacitor 32 drops below the threshold gate voltage of the FET. The FET is held conducting just beyond the time of complete discharge of the storage capacitor 11 and ring-out of the coil. The SCR 14 turns off and the storage capacitor can begin recharging for the next cycle.

The positive shut-off of the SCR 14 makes the circuit much more versatile. For example, a diode 35 can be placed in parallel with the primary to lengthen the duration of the spark. The shut-off of the SCR is less sensitive to the output voltage of the full wave rectifier. There is no need to attempt to synchronize the nodes in the generator output with the discharge of the storage capacitor. Also, the generator output may be increased without regard to the holding current rating of the SCR 14.

In a particular ignition for which the circuit according to this invention is useful, the time between spark firings is 5 milliseconds. The time between polarity reversals of the alternator or generator is between 1 and 2 milliseconds. A 1 or 2 millisecond delay before recharging of the storage capacitor is considered very undesirable. With the SCR shut-off circuit according to this invention, discharge of the storage capacitor would be expected in about 40 microseconds. The gating circuit of the FET switch is designed to hold the FET in conduction for about 200 to 300 microseconds to allow for coil ring out. Hence, recharge of the storage capacitor can begin after about 200 to 300 microseconds as opposed to 1 to 2 milliseconds. The times given in this paragraph are exemplary only. The time between firings depends upon the number of cylinders being served by the ignition system and the speed of the engine. The time between polarity reversals also depends upon the speed of the engine as the alternator is driven by the engine. Preferably, the capacitor and resistor at the gate of the FET switch should be sized to enable the FET switch to ground the output of the alternator for about 100 to 200 microseconds after the storage capacitor has discharged.

It is possible to modify the circuit of FIG. 1 somewhat. For example, it may be possible to use a bipolar transistor in place of the FET. However, if this is done it must be recognized that the capacitor 32 will discharge both through the resistor 33 and the base of the transistor. This can be considered in design of the timing circuit with some difficulty since the voltage current relationship through the base is not linear. Moreover, if the temperature of the transistor is not held constant, the current voltage relationship for the base will not be held constant. It is also possible to substitute an optocoupled device having a photo SCR rather than a phototransistor. In this case, attention must be paid to selection of the components such that the current in the photo SCR falls below its holding current enabling shut-off.

Figure 2:
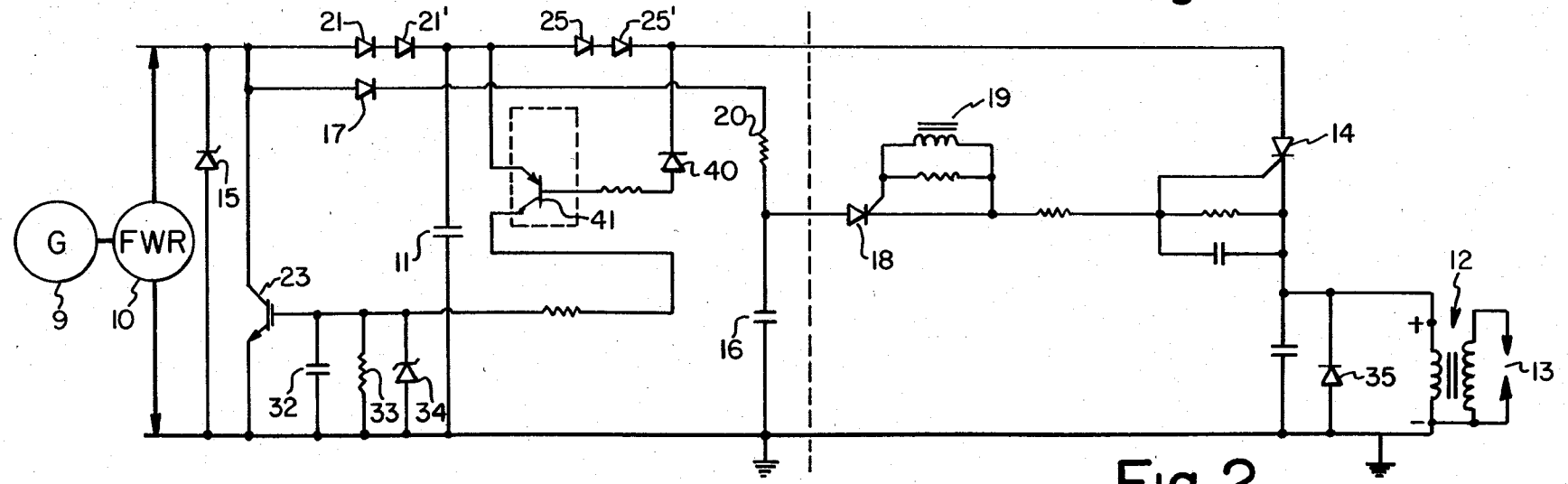

Referring now to FIG. 2, a circuit is shown for using a transistor to sense the discharge current in diodes 25, 25' rather than an optocoupler as in FIG. 1. All elements having the same function as in FIG. 1 are given the same numeral designations in FIG. 2. Voltage across diode 25, 25' develops the base emitter voltage $V_{BE}$ required to turn on bipolar transistor 41.

Having thus defined the invention with the detail and particularity required by the Patent Laws, what is desired protected by Letters Patent is set forth in the following claims.

What is claimed is:

1. A capacitive discharge ignition system for an internal combustion engine and for use with a generator powered current source comprising a storage capacitor charged through a diode, at least one thyristor for discharging the storage capacitor to transfer energy to at least one spark plug and a trigger circuit for gating the at least one thyristor in synchronism with an internal combustion engine with which the ignition system may be associated, the improvement comprising (a) the storage capacitor being discharged through a diode circuit, (b) a circuit for sensing flow in the discharge diode circuit and generating a discharge signal indicative thereof, (c) a solid state device for switching the output of the generator to ground, and (d) a means for gating the solid state device into conduction in response to said discharge signal.

2. The improvement according to claim 1 wherein said circuit for sensing flow in the discharge diode is an LED in series with a protective resistor, both in parallel with the discharge diode circuit and arranged to conduct current when the discharge saturate.

3. The improvement according to claim 1 wherein said gating means comprises an optocoupled device connecting one side of the storage capacitor and the gate of the solid state device.

4. The improvement according to claim 1 wherein the gating means comprises a transistor, wherein a voltage developed across the said diode circuit provides a base emitter voltage on the transistor sufficient to turn the transistor into conduction.

5. The improvement according to claim 1 wherein the solid state device comprises an FET.

6. The improvement according to claim 1 wherein the thyristor is an SCR.

7. The improvement according to claim 1 wherein the discharge signal generating means holds the signal until just after the storage capacitor is discharged.

8. The improvement according to claim 1 wherein at the solid state device gate there is a small holding capacitor, and a resistor and zener diode in parallel with the holding capacitor, such that the small capacitor charges when the discharge signal is applied to the gate, the resistor discharges the capacitor when the discharge signal terminates and the zener diode limits the voltage across the small capacitor.

9. A generator powered capacitive discharge ignition system for an internal combustion engine comprising a generator for charging a storage capacitor through a diode, at least one spark plug transformer and at least one spark plug in series with the secondary coil of the transformer, at least one SCR for discharging the storage capacitor to the primary of one spark plug transformer and a trigger circuit for gating the at least one SCR in synchronism with an internal combustion engine with which the ignition system may be associated, the improvement comprising (a) said storage capacitor discharge through a diode circuit, (b) a circuit for sensing flow in the discharge diode circuit and generating a discharge signal indicative thereof, comprising an LED in series with a protective resistor, both in parallel with the discharge diode circuit and arranged to conduct current when the discharge diodes saturate, (c) a high gate impedance FET for shunting the output of the generator to ground, (d) a means for gating the FET into conduction in response to said discharge signal comprising an optocoupled device connecting one side of the storage capacitor and the gate of the FET, and (e) means for holding the discharge signal until just after the storage capacitor is discharged comprising an RC timing circuit at the gate of the FET.

* * * * *